US005977471A

United States Patent [19]

Rosenzweig

[11] Patent Number: 5,977,471

[45] Date of Patent: Nov. 2, 1999

[54] MIDI LOCALIZATION ALONE AND IN CONJUNCTION WITH THREE DIMENSIONAL AUDIO RENDERING

[75] Inventor: Michael D. Rosenzweig, Hillsboro, Oreg.

[73] Assignee: Intel Corporation, Santa Clara, Calif.

[21] Appl. No.: 08/824,929

[22] Filed: Mar. 27, 1997

[51] Int. Cl.[6] ..... H04R 5/00; H04R 5/02

[52] U.S. Cl. ..... 84/633; 84/626; 84/645; 84/662; 84/665; 381/17

[58] Field of Search ..... 84/626, 633, 645, 84/647, 662, 665; 381/17, 310

[56] References Cited

U.S. PATENT DOCUMENTS 5,208,860 5/1993 Lowe et al. ..... 381/17
5,742,688 4/1998 Ogawa et al. ..... 381/17
5,850,455 12/1998 Arnold et al. ..... 381/17

*Primary Examiner*—Robert E. Nappi
*Assistant Examiner*—Marlon T. Fletcher
*Attorney, Agent, or Firm*—Jeffrey S. Draeger

[57] ABSTRACT

A method of and apparatus for enhancing an audio signal to reflect positional information of a sound emitting object in a simulation are described. The method includes determining a parameter describing a location of the sound emitting object. A setting for the audio signal is adjusted based on the first parameter by sending an adjustment command to an audio interface device. Either the whole audio signal, or a portion thereof is transferred to the audio interface device after the adjustment command. The apparatus includes a processor, a memory, and an audio interface coupled to a bus. The memory contains an audio adjustment routine which, when executed by the processor, sends an adjustment command to the audio interface device to adjust a characteristic of an audio signal. The adjustment command reflects a spatial location of an emitter in a simulated environment.

31 Claims, 3 Drawing Sheets

MIDI LOCALIZATION ALONE AND IN CONJUNCTION WITH THREE DIMENSIONAL AUDIO RENDERING

FIELD OF THE INVENTION

The present invention pertains to the field of audio processing. More specifically, the present invention pertains to rendering of an audio signal represented in a format which does not allow direct mathematical manipulations to simulate spatial effects.

BACKGROUND

Advances in computing technology have fostered a great expansion in computerized simulation of scenes ranging from rooms and buildings to entire worlds. These simulations create "virtual environments" in which users move at a desired pace and via a desired route rather than a course strictly prescribed by the simulation. The computer system tracks the locations of the objects in the environment and has detailed information about the appearance or other characteristics of each object. The computer then presents, or renders, the environment as it appears from the perspective of the user.

Both audio and video signal processing are important to the presentation of this virtual environment. Audio can convey a three hundred and sixty degree perspective unavailable through the relatively narrow field of view in which eyes can focus. In this manner, audio can enhance the spatial content of the virtual environment by reinforcing or complementing the video presentation. Of course, additional processing power is required to properly process the audio signals.

Various signal processing tasks simulate the interaction of the observer with the environment. A well known technique of ray tracing is often used to provide the appropriate visual perspective of objects in the environment, and the propagation of sound may be modeled by "localization" techniques which mathematically filter "digitized audio" (a digital representation of analog audio using periodic samples). Audio localization is filtering of an audio signal to reflect spatial positioning of objects in the environment being simulated. The spatial information necessary for such audio and video rendering techniques may be tracked by any of a variety of known techniques used to track locations of objects in computer simulations.

The image processing tasks associated with such simulations are well known to be computationally intensive. On top of image processing, the additional task of manipulating one or more high quality digitized audio streams may consume a significant portion of remaining processing resources. Since the available processing power is always limited, tasks are prioritized, and the audio presentation is often compromised by including less or lower quality audio in order to accommodate more dramatic effects such as video processing.

Furthermore, high quality digitized audio streams require large portions of memory and significant bandwidth if retrieved using a network. Audio thus also burdens either a user operating with limited memory resources or a user downloading information from a network. Such inconveniences reduce the overall appeal of supplementing a virtual environment with localized audio.

Audio information can, however, be represented in a more compact format which may alleviate some of the processing, memory, and network burdens resulting from audio rendering. The Musical Instrument Digital Interface (MIDI) format is one well known format for storing digital musical information in a compact fashion. MIDI has been used extensively in keyboards and other electronic devices such as personal computers to create and store entire songs as well as backgrounds and other portions of compositions. The relatively low storage space required by the efficient MIDI format allows users to build and maintain libraries of MIDI sounds, effects, and musical interludes.

MIDI provides a more compact form of storage for musical information than typical digitized audio by representing musical information with high level commands (e.g., a command to hold a certain note by a particular instrument for a specified duration). A MIDI file as small as several dozen kilobytes may contain several minutes of background music, whereas several megabytes of digitized audio may be required to represent the same duration of music.

MIDI does, however, require a processing engine to recreate the represented sounds. In a computer system, a sound card or other MIDI engine typically uses synthesis or wave table techniques to provide the sound requested. The MIDI commands are passed to the sound card. By doing so, the system does not perform a conversion of the commands to raw digital data which could be manipulated by the main processing resources of the system. The synthesized sound may also be mixed by the sound card with digitized audio received from the system and played directly on computer speaker system.

Thus, when MIDI sounds are played, the main processor does not have access to the raw digital data available when digitized audio is played. This precludes digital filtering by the main processor and prevents MIDI compositions from being manipulated as a part of the presentation of a virtual environment. This inability to manipulate MIDI limits the use of a vast array of pre-existing sounds where audio localization is desired. Additionally, the need to localize sounds using cumbersome digitized audio, rather then a compact representation such as MIDI, exacerbates the processing, storage, and networking burdens which impede further incorporation of sound into virtual environments.

SUMMARY

A method of enhancing an audio signal to reflect positional information of a sound emitting object in a simulation is described. The method includes determining a parameter describing a location of the sound emitting object. A setting for the audio signal is adjusted based on the first parameter by sending an adjustment command to an audio interface device. Either the whole audio signal, or a portion thereof, is transferred to the audio interface device after the adjustment command.

A system implementing the present invention is also described. This system includes a processor, a memory, and an audio interface coupled to a bus. The memory contains an audio adjustment routine which, when executed by the processor, sends an adjustment command to the audio interface device to adjust a characteristic of an audio signal. The adjustment command reflects a spatial location of an emitter in a simulated environment.

BRIEF DESCRIPTION OF THE FIGURES

The present invention is illustrated by way of example and not limitation in the figures of the accompanying drawings.

DETAILED DESCRIPTION

The present invention provides MIDI localization alone and in conjunction with three dimensional audio rendering. In the following description, numerous specific details such as digital signal formats, signal rendering applications, and hardware arrangements are set forth in order to provide a more thorough understanding of the present invention. It will be appreciated, however, by one skilled in the art that the invention may be practiced without such specific details. In other instances, instruction sequences and filtering algorithms have not been shown in detail in order not to obscure the invention. Those of ordinary skill in the art, with the included descriptions, will be able to implement the necessary functions without undue experimentation.

The present invention allows localization of a non-digitized audio signal in conjunction with digitized audio rendering. As will be further discussed below, one embodiment localizes existing MIDI compositions in an interactive multi-media (i.e., audio and video) presentation. This, in turn, frees processing resources while still providing a robust audio presentation. In addition, the present invention conserves network bandwidth and storage space by allowing a manipulation of audio represented by a compact audio format.

Most compact audio formats, like MIDI, require conversion either to digitized or analog signals to reconstruct the represented audio signal. This conversion stage before playback allows an opportunity to adjust the audio presentation. The present invention uses this opportunity to add spatial information to an audio passage by sending commands to an audio interface performing such conversion prior to playback. The commands adjust volume, panning, or other aspects of the audio presentation to localize the audio based on the simulation environment.

Figure 1:
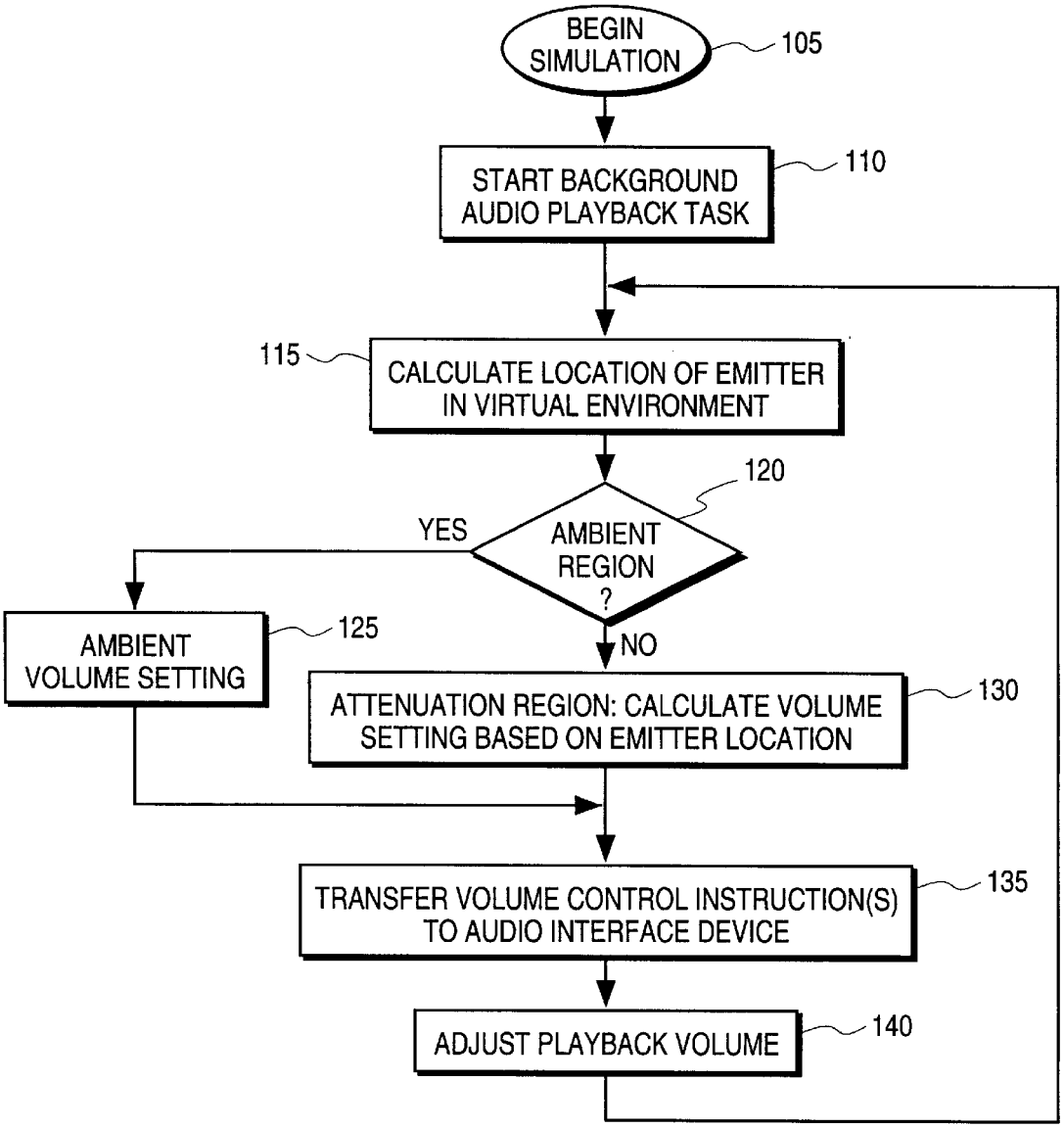
FIG. 1 illustrates one embodiment of a method for localizing an audio signal based on an emitter location in a simulation.
Figure 2:
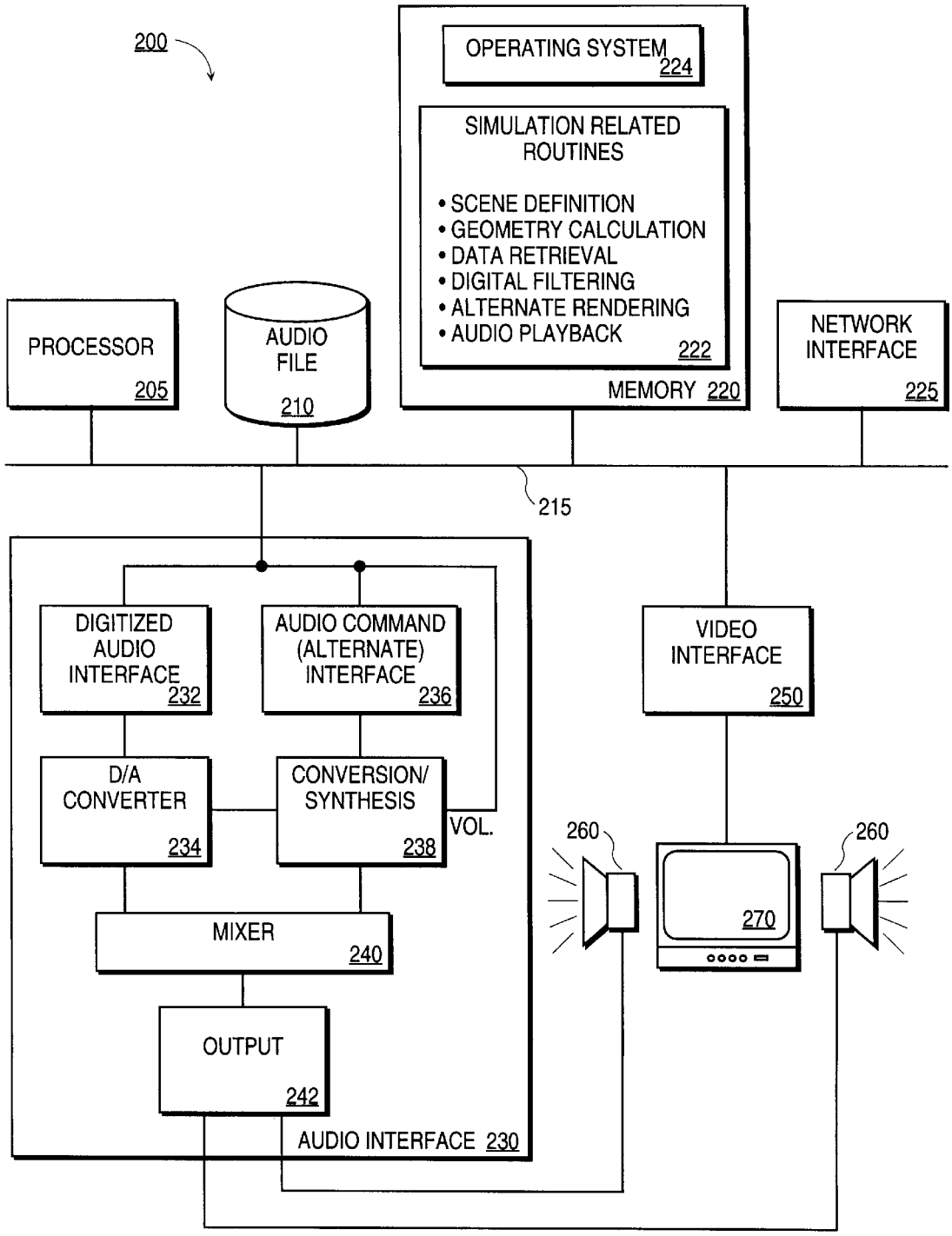
FIG. 2 illustrates one embodiment of a computer system of the present invention.

FIG. 1 illustrates one method of the present invention which enhances an audio signal from a single emitter at a certain location in a simulated virtual environment. This method may be executed, for example, on a system 200 (illustrated in FIG. 2) having a processor 205 which executes appropriate simulation routines 222 from a memory 220. The emitter has an associated file on a disk drive 210 containing audio data in a non-digitized format. A non-digitized format is a format other than a representation of the lo audio data as periodic samples defining an analog signal (e.g., MIDI). This alternate representation may have a variable compression ratio and/or may not be a format recognizable by the processor 205.

The audio signal in its alternate format is localized according to a simulation started in step 105. A broad range of simulations and applications may employ the illustrated method. Examples of such simulations and applications include games, educational simulations, training simulations, and computerized information retrieval systems. In essence, any application enhanced by audio modulated with spatial information may employ these techniques.

Typically, a scene definition routine of the simulation portrays the virtual environment from the perspective of an "observer". This observer may or may not be present in the simulation and only represents a vantage point from which the environment appears to have been captured. Thus, the "observer" may simply be a point from which calculations are made. In cases where the observer is depicted by the simulation, the visual perspective shown by the simulation is typically removed slightly from the observer so the observer can be seen as part of the simulation.

Each scene in the virtual environment includes a number of physical objects, some of which emit sound ("emitters"). When an observer is within range of an emitter, the simulation starts playing the appropriate audio selection as shown in step 110. When an observer moves in and out of range of the emitter, the simulation may either freeze time (i.e., stop the audio) or may allow time to continue elapsing as though the music were still playing, only stopping and starting the actual audio output. Typically, a data retrieval task forwards the audio signal to an audio interface 230 while operating as a background process in the system 200. As a background process, the audio retrieval may be executed at a low priority or may be offloaded from the processor 205 to a direct memory access controller included on the audio interface or otherwise provided in the system.

The present invention is particularly advantageous in an environment where background emitters (i.e., emitters providing somewhat non-directional audio such as the sound of running water, traffic noise, or background music) are used. For example, several minutes of digitized background music may require an order of magnitude more data or more than a compact representation such as MIDI. The high bandwidth required for digitized audio not only burdens memory and disk resources, but also significantly impacts network or Internet based applications which require downloading of audio segments.

Additionally, even though the art of digital audio processing allows extensive control and modification of fully digitized audio data, elaborate filtering may not be required for background sound effects. In fact, volume attenuation and/or panning adjustments may be sufficient to infuse reality into background audio. Thus the workload required to provide robust and varied background sounds can be reduced when panning and/or volume adjustments are available through an alternate mechanism not requiring digital signal processing on the part of the processor 205.

In order to determine what adjustments to make to the audio signal, the simulation calculates a location of the emitter in the virtual environment as shown in step 115. The location is usually calculated relative to the observer or any other viewpoint from which the simulation is portrayed. Notably, an initial calculation typically performed with step 115 determines which emitters are within the hearing range of the observer. This calculation occurs regularly as the simulation progresses.

The spatial relationship between the observer and the emitter may be defined by a number of parameters. For example, an elevation, orientation, and distance can be used. The elevation refers to the height of the emitter with respect to the position of the observer in a three dimensional environment. The orientation refers to the direction that the observer is facing, and the distance reflects the total distance between the two. In the system 200, a geometry calculation routine makes the appropriate calculations and determines at least one parameter reflecting this positional information.

Depending on the distance between the emitter and the observer, step 120 determines whether the observer is within an ambient region. This is the region closest to the emitter in which a constant volume setting approximates the sound received by the observer. If the observer is within the appropriate distance, the ambient volume level is selected as shown in step 125.

If the observer is not within the ambient region, a calculation is performed in step 130 to approximate sound attenuation over the calculated distance. Approximations such as a linear volume/distance decrease may be used, as may complex equations which more accurately model the sound distribution. For example, room or environmental characteristics which depend on the scene depicted in the simulation may be factored in to the sound calculation. Additionally, the attenuation region may encompass the entire scene. That is, the audio signal may be volume-adjusted in the entire scene rather than bifurcating the scene into ambient and attenuation regions.

While numerous facets of sound propagation are modeled and various tonal characteristics adjusted in some embodiments of the present invention, one embodiment manipulates a single volume control based on the distance between the observer and the emitter. In this embodiment, the audio interface 230 is a sound card which receives MIDI commands and synthesizes an audio signal using a conversion circuit 238 having a volume adjustment.

In an alternate embodiment, the audio interface 230 may have left and right volume controls available. In this case, orientation information as well as distance information is used to set the proper levels for the stereo sound, allowing a panning effect to simulate movement around the observer. As previously mentioned, other characteristics of sound, such as bass, treble, or other tonal characteristics, may be adjusted depending on the capabilities of the audio interface device 230. Thus, step 130 may be accomplished by a number of techniques which adjust the audio presentation based on the spatial location of the emitter.

Once the adjustment (e.g., a volume setting) is calculated, the processor 205 generates one or more volume adjustment commands which transmit the calculated volume setting to the audio interface 230 as shown in step 135. The volume setting may be transferred to the audio interface by an instruction which either sets a particular volume level or commands an incremental change in the present volume level.

This volume adjustment alters the volume setting for sounds already being played by the background task started in step 110. The background task transfers data from a file on the disk drive 210 associated with the background emitter to the audio interface 230. Since a compressed (non-digitized) format is used to represent this audio, an alternate interface 236 other than the digitized audio interface 232 receives the audio data. The conversion/synthesis circuit 238 generates an output audio signal with its volume adjusted according to the volume adjustment command. Thus, the conversion circuit receiving the command from the processor 205 adjusts the playback volume as shown in step 140.

Depending on the particular encoding used for the audio signal and depending on the conversion circuit 238, either analog or digital data may be generated. If digital data is generated, an analog signal may subsequently be generated by a digital-to-analog converter 234. If an analog output signal is generated, as is the case in one embodiment where MIDI encoding is used, the conversion circuit 238 synthesizes an analog signal which is then passed on to a mixer 240. From the mixer 240, an output circuit 242 generates amplified audio signals for speakers 260. This audio is played back through speakers 260 in conjunction with video provided on a display 270 through a video interface 250.

Thus, the simulation presented via the display 270 and the speakers 260 includes audio localized based on spatial information from the simulation. This audio localization preserves processor and system bandwidth by using a compact audio representation and by not performing digital signal processing using the processor 205. In many network or Internet based applications, keeping system bandwidth utilization down is crucial since data for the audio information comes through a network interface 225 before being stored on the disk drive 210. Often such a network connection, whether a modem or a more direct connection to the network, represents a bottleneck, and any reduction in data passed through this bottleneck improves overall system performance.

It should be noted that the system 200 may be configured differently for different applications. Although the processor 205 is represented by a single box, many suitable configurations may be used. Processor 205 may be any instruction execution mechanism which can execute commands from an instruction storage mechanism as represented by memory 220. Thus, the storage and execution circuitry can be integrated into a single device (i.e. "hard-wired") or may be executed by a general purpose processor or a dedicated media processor. Alternately, the processor 205 and the memory 220 each can be split into separate processors and memories in a client/server or network-computer/server arrangement.

Figure 3:
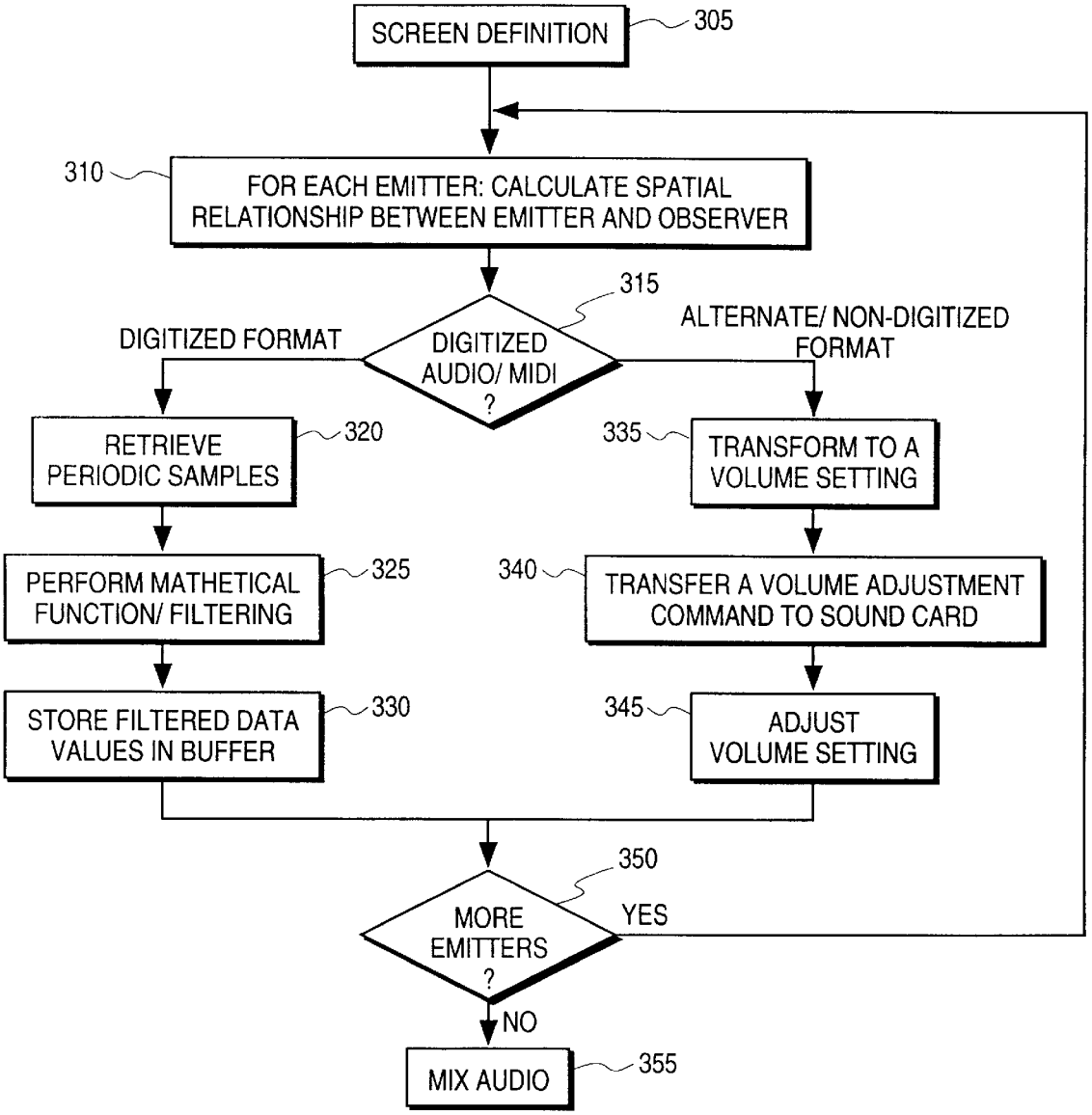
FIG. 3 illustrates one embodiment of a method for providing localization in a simulation having multiple emitters with corresponding audio tracks represented in different formats.

Another method of the present invention which may be executed on any such appropriate system is illustrated in FIG. 3. This method allows localizing audio for multiple emitters in a virtual environment. Each emitter in this environment has an associated audio file either stored locally on the disk drive 210 or available through the network interface 225. At least one of the emitters has an audio file which is processed by the processor 205 in a digitized format (a "digital emitter"). Typically, these files are in a well known format such as the wave (.wav) format. One emitter in the simulation has data stored in an alternate, non-digitized format (e.g., a "MIDI emitter"). Often, the MIDI emitter is used for background audio because the audio interface 230 affords less control over the ultimate audio output than would digital signal processing under control of the processor 205.

In step 305, the processor 205 executes a scene definition routine which places all visual objects, all emitters, and the observer (if shown) in the simulation. Audio rendering routines then begin a process of stepping through the entire list of emitters. This begins, as shown in step 310, with the processor 205 executing the geometry calculation routine to determine the spatial relationship between a selected emitter and the observer.

As shown in step 315, a data retrieval routine follows one of two procedures depending on whether the selected emitter is a digital emitter or a MIDI emitter. Where the audio file associated with the selected emitter contains digitized audio, a routine from the operating system 224 executed by the processor 205 retrieves data from the file as shown in step 320. Typically, periodic samples stored in the file are transferred to a buffer in memory 220.

Filtering, as shown in step 325, may be performed either while data is being transferred to memory or once the data has been buffered. Many known mathematical functions or filtering techniques may be applied to the digitized audio to provide localization effects. For example, these functions include scaling of one or more channels and filtering using functions such as head related transfer function, functions which model human perception of sound w3aves based on the spatial location with respect to a point of observation.

Such digital processing, however, requires the cumbersome digital data to be transferred over the network interface 225 (if downloaded) or retrieved from the disk drive 210, and then processed by the processor 205. Additionally, the processed values are again buffered as shown in step 330 and transferred to the digitized audio interface 232.

If there are more emitters, as determined in step 350, the audio rendering routines continue processing each emitter. If the next selected emitter is a digital emitter, the same processing steps are performed using a spatial relationship between the newly selected emitter and the observer. A combined buffer may be used in step 330 to store the cumulative digitized audio where multiple digital emitters are present in one simulation.

When the audio rendering routine encounters a MIDI emitter in step 315, an alternate rendering procedure is employed. The parameters defining the spatial relationship are transformed into a volume setting as shown in step 335. This volume setting is reflected in a volume adjustment command sent to the audio interface 230 (e.g., a sound card) in step 340. The audio interface 230 adjusts the volume setting in step 345 via the volume adjust input to the conversion circuit 238.

Once the audio signals are generated for all of the emitters present in the particular scene, the final audio signal can be constructed by mixing all of the processed audio. Accordingly, in step 355, both the digitally processed and the volume adjusted audio signals are combined by the mixer 240 prior to amplification and playback through the speakers 260 in conjunction with the video portion of the simulation presented on the display 270.

Thus, the method and apparatus of the present invention provides MIDI localization in conjunction with multi-dimensional audio rendering. While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art upon studying this disclosure.

What is claimed is:

1. A method of enhancing a first audio signal to reflect positional information of a first emitter in a simulation, the method comprising the steps of:

determining a first parameter describing a location of the first emitter with respect to an observer in said simulation by calculating a distance from the emitter in said simulation to the observer;

adjusting a setting for the first audio signal by sending an adjustment command based on the first parameter to an audio interface device;

determining a second parameter describing a second location of a second emitter, the second emitter having an associated second audio signal represented in a digitized audio format, the digitized audio format having a plurality of periodic digital samples; and adjusting the second audio signal by performing a mathematical function on the plurality of periodic digital samples.

2. The method of claim 1 wherein the setting is a volume control setting.

3. The method of claim 1 further comprising the step of:

calculating the setting based on the first parameter, the setting being reflected in the adjustment command.

4. The method of claim 3 wherein the step of calculating further comprises the steps of:

selecting an ambient volume setting if an observer is within an ambient region; and calculating an attenuated volume setting based on the first parameter if the observer is within an attenuation region.

5. The method of claim 1 further comprising the step of:

downloading the first audio signal through a network interface.

6. The method of claim 1 wherein the step of determining further comprises the steps of:

calculating an elevation of the first emitter with respect to a receiver;

calculating a distance between the first emitter and the receiver;

calculating an orientation of the receiver with respect to the first emitter;

calculating the first parameter based on the elevation, the distance, and the orientation; and calculating a second parameter based on the elevation, the distance, and the orientation.

7. The method of claim 6 wherein the step of adjusting further comprises the steps of:

adjusting a left channel volume level for the first audio signal according to the first parameter; and adjusting a right channel volume level for the first audio signal according to the second parameter.

8. The method of claim 1 wherein the adjustment command is a volume adjustment command, and wherein the method further comprises the steps of:

synthesizing a first analog signal from the first audio signal; and scaling the first analog signal according to the volume adjustment command.

9. The method of claim 1 wherein the step of adjusting the second audio signal further comprises the steps of:

retrieving the plurality of periodic digital samples from a file;

performing a filtering operation on the plurality of periodic digital samples to form a plurality of filtered data values; and storing the plurality of filtered data values in a buffer.

10. The method of claim 1 further comprising the steps of:

mixing the first audio signal and the second audio signal to form a combined audio signal; and amplifying the combined audio signal.

11. A method of localizing a first audio signal according to a spatial relationship between an emitter and an observer in a virtual environment, the method comprising the steps of:

calculating a parameter representative of the spatial relationship between the emitter and the observer;

transforming the parameter into a volume setting by selecting an ambient volume setting if the observer is within an ambient region;

calculating an attenuated volume setting based on the parameter if the observer is within an attenuated region; and transferring a command conveying the volume setting to an audio interface device.

12. The method of claim 11 wherein the volume setting sets a volume level for a left channel, and the method further comprises the steps of:

determining a second volume setting for a right channel; and transferring a second command conveying the second volume setting to the audio interface device.

13. The method of claim 11 further comprising the steps of:

calculating a second parameter representative of a second spatial relationship between a second emitter and the observer;

performing a mathematical function on a digitized audio signal to generate a localized digital audio signal, the mathematical function depending on the second parameter; and transferring the localized digital audio signal to the audio interface device.

14. The method of claim 13 further comprising the step of: retrieving data for the first audio signal and the digitized audio signal.

15. The method of claim 14 wherein the step of retrieving further comprises the steps of:

determining whether a selected audio signal is a digitized data stream; and moving a plurality of bits representing the digitized audio signal to a buffer if the selected audio signal is the digitized data stream.

16. The method of claim 15 wherein the step of transferring a command to the audio interface device is executed if the selected audio signal is the first audio signal rather than the digitized audio signal.

17. A system, comprising:

a bus;

a processor coupled to the bus;

an audio interface device coupled to the bus. the audio interface device comprising:

a digitized audio interface for receiving a digitized audio signal, the digitized audio signal being represented by a plurality of periodic digital samples;

a second interface for receiving audio in an alternate format, wherein said first audio signal is represented in the alternate format and the processor, when executing the audio adjustment routine, sends the adjustment command to the second interface; and a memory coupled to the bus, said memory containing an audio adjustment routine which, when executed by the processor, sends an adjustment command to the audio interface device to adjust a characteristic of a first audio signal, the adjustment command reflecting a spatial location of an emitter in a simulated environment.

18. The system of claim 17 wherein the memory further contains a digital signal processing routine which, when executed by the processor, performs digital signal processing on the plurality of periodic digital samples.

19. The system of claim 17 wherein the alternate format is a format having a variable compression ratio such that a conversion is required before mathematical computations can be used to localize the first audio signal.

20. The system of claim 17 wherein the audio interface further comprises:

a mixer circuit coupled to generate, from the digitized audio signal and the first audio signal, a mixed audio signal; and an output circuit coupled to receive the mixed audio signal and generate an output audio signal.

21. The system of claim 20 wherein the mixer circuit comprises:

a conversion circuit having a volume adjustment control responsive to the adjustment command, the conversion circuit receiving the first audio signal and generating a first analog signal; and a digital-to-analog converter coupled to convert the digitized audio signal to a second analog signal.

22. The system of claim 17 wherein the memory further contains:

a scene definition routine which, when executed by the processor, simulates a scene including the emitter and an observer;

a geometry calculation routine which, when executed by the processor, computes a parameter defining a spatial relationship of the emitter with respect to the observer, the parameter being passed to the audio adjustment routine and reflected in the adjustment command.

23. The system of claim 22 wherein the first audio signal is a MIDI signal comprising a plurality of MIDI commands, and wherein the memory further contains:

a MIDI playback routine which, when executed by the processor, retrieves the plurality of MIDI commands from a file and passes the plurality of MIDI commands to the audio interface device, the MIDI playback routine being executed by the processor as a background thread.

24. The system of claim 17 wherein the memory further contains:

a scene definition routine which, when executed by the processor, simulates a scene having a plurality of emitters and an observer, one of said plurality of emitters being a background emitter.

25. The system of claim 24 wherein the memory further contains:

a data processing routine which, when executed by the processor, processes a digitized audio signal for each of said plurality of emitters other than said background emitter using a mathematical function determined by a spatial relationship between the respective emitter and an observer.

26. The system of claim 25 wherein the memory further contains:

an audio rendering routine which, when executed by the processor, calls a spatial relationship determination routine for each of the plurality of emitters, calls the data processing routine for each of the plurality of emitters other than the background emitter, and calls the audio adjustment routine for the background emitter.

27. An apparatus comprising:

a bus;

a processor coupled to the bus;

a memory coupled to the bus, said memory containing an audio adjustment routine which, when executed by the processor, determines whether an emitter is in an ambient region of a simulation or is in an attenuation region of said simulation and accordingly adjusts a volume level of a first audio signal to a ambient volume if the emitter is in the ambient region and to one of a plurality of volume levels if the emitter is in the attenuation region.

28. The apparatus of claim 27 further comprising:

an audio interface device coupled to receive the first audio signal and coupled to be adjusted by the audio adjustment routine, the audio interface device generating an analog audio output signal from the first audio signal.

29. The apparatus of claim 28 wherein the audio interface device is also coupled to receive a second audio signal that is a digital audio signal having a plurality of periodic samples, the analog audio output signal also including the digital audio signal, and wherein the memory further contains a digital signal processing routine to process said plurality of periodic samples.

30. An article comprising:

a machine readable medium having embodied thereon a plurality of instructions, which, if executed by a machine, cause the machine to perform:

determining whether an emitter is in an ambient region of a simulation or is in an attenuation region of said simulation;

adjusting a volume level of a first audio signal to a ambient volume if the emitter is in the ambient region; and adjusting the volume level of the first audio signal to one of a plurality of volume levels if the emitter is in the attenuation region.

31. An article comprising:

a machine readable medium having embodied thereon a plurality of instructions, which, if executed by a machine, cause the machine to perform:

determining a first parameter describing a location of the first emitter with respect to an observer in said simulation by calculating a distance from the emitter in said simulation to the observer;

adjusting a setting for the first audio signal by sending an adjustment command based on the first parameter to an audio interface device;

determining a second parameter describing a second location of a second emitter, the second emitter having an associated second audio signal represented in a digitized audio format, the digitized audio format having a plurality of periodic digital samples; and adjusting the second audio signal by performing a mathematical function on the plurality of periodic digital samples.

* * * * *

UNITED STATES PATENT AND TRADEMARK OFFICE

CERTIFICATE OF CORRECTION

PATENT NO. : 5,977,471
DATED : November 2, 1999
INVENTOR(S) : Rosenzweig

It is certified that error appears in the above-identified patent and that said Letters Patent is hereby corrected as shown below:

Column 3,
Line 52, before "audio data", delete "lo".

Signed and Sealed this

Fifteenth Day of July, 2003

JAMES E. ROGAN
*Director of the United States Patent and Trademark Office*